US008258683B2

(12) United States Patent
Chuang

(10) Patent No.: US 8,258,683 B2
(45) Date of Patent: Sep. 4, 2012

(54) INSULATION REINFORCING LIGHT BULB

(76) Inventor: Sheng-Yi Chuang, Hsinchu (TW)

( * ) Notice: Subject to any disclaimer, the term of this patent is extended or adjusted under 35 U.S.C. 154(b) by 0 days.

(21) Appl. No.: 13/012,581

(22) Filed: Jan. 24, 2011

(65) Prior Publication Data

US 2012/0187817 A1 Jul. 26, 2012

(51) Int. Cl.
*F21V 29/00* (2006.01)
*H01J 61/52* (2006.01)

(52) U.S. Cl. ..... 313/46; 313/512; 362/294; 362/373

(58) Field of Classification Search ..... None
See application file for complete search history.

(56) References Cited

U.S. PATENT DOCUMENTS

| | | | | |
|---|---|---|---|---|
| 7,965,023 | B1 * | 6/2011 | Liang | 313/45 |
| 2010/0253200 | A1 * | 10/2010 | Osawa et al. | 313/46 |
| 2011/0101861 | A1 * | 5/2011 | Yoo | 315/35 |
| 2012/0007486 | A1 * | 1/2012 | Mora et al. | 313/46 |

FOREIGN PATENT DOCUMENTS

| | | |
|---|---|---|
| TW | I293807 | 2/2008 |
| TW | M345944 | 12/2008 |
| TW | M358247 | 6/2009 |
| TW | 201020457 | 6/2010 |
| TW | M381743 | 6/2010 |

* cited by examiner

*Primary Examiner* — Ashok Patel
(74) *Attorney, Agent, or Firm* — Muncy, Geissler, Olds & Lowe, PLLC

(57) ABSTRACT

An insulation reinforcing light bulb includes a light penetrable shell, a power receiving base, a heat sink and an assembling holder located between the light penetrable shell and the power receiving base, at least one light source baseboard located in the light penetrable shell and a power conversion board electrically connected to the light source baseboard and the power receiving base. The heat sink has a housing chamber to hold the power conversion board. The light bulb further includes an isolation element held in the housing chamber. The isolation element has an isolation wall interposed between the power conversion board and the heat sink to form a circuit housing compartment to hold the power conversion board, and a wiring outlet formed on the isolation wall to allow wires to be led from the power conversion board to connect to the light source baseboard.

15 Claims, 4 Drawing Sheets

INSULATION REINFORCING LIGHT BULB

FIELD OF THE INVENTION

The present invention relates to an insulation reinforcing light bulb and particularly to a light bulb including a power conversion board to drive at least one LED and an isolation element to enhance insulation capability of the power conversion board.

BACKGROUND OF THE INVENTION

Light emitting diode (LED) provides many advantages such as a longer lifespan, less power consumption, higher illumination and more eco-friendly materials. With advance of LED fabrication process and lower cost, applications of LED also have been greatly expanded, in addition to being adopted on traffic lights or indication light signals of electric appliances, it also can be used on environmental decoration, lighting fixtures and the like. In order to allow the LED to be adapted to the general light bulbs, many techniques have been proposed in prior arts to couple the LED with conventional lamp shell. For instance, R.O.C. patent No. I293807 entitled "LED light bulb equipped with a constant current circuit" discloses an LED light bulb that includes a lamp cap, a lamp shell, a plurality of LEDs coupled in series and a step-down constant current circuit. The lamp cap has electrodes connected to a power source. The LEDs are connected to the step-down constant current circuit to receive a constant current to let the LEDs emit light. The LED light bulb thus formed can be directly mounted onto a conventional lamp socket for use. But driving the LEDs requires a stable DC current. The driving circuit to convert commercial power to DC generates and accumulates waste heat constantly during conversion. Moreover, DC passing through the impedance of the LEDs also generates a lot of waste heat. All those waste heat produces excessive high temperature and could damage the LEDs or driving circuit after used for a long duration, or lower the lifespan. To remedy these problems, many types of LED light bulbs equipped with a heat dissipation structure have been developed in the industry. For instance, R.O.C. patent No. M358247 entitled "LED lamp adaptable to varying lamp sockets" discloses an LED heat dissipation module with a coupling end having an opening and an annular latch groove formed on the periphery of the opening to couple with a corresponding lamp socket. The opening has another end coupled with an LED lighting element. The LED lighting element is electrically connected to the lamp socket. The LED heat dissipation module is located on the peripheries of the LED lighting element and lamp socket to conduct heat. Other references of LED light bulbs adopting similar metal heat sink can be found in R.O.C. patent Nos. M345944 and M381743, and R.O.C. publication No. 201020457.

All the aforesaid references use a metal heat sink (mostly aluminum heat sink) to enhance heat dissipation to allow the light bulb to receive greater power without being burned. However, the conventional LED light bulbs mostly adopt a RC drop passive power source (called "passive power source" in short hereinafter) incorporating with a rectification circuit to supply power. The passive power source has poor efficiency during greater power output. To increase the power, the size of the circuit also has to be increased. The reason why the conventional LED light bulbs adopt the passive power source is because it is easier to pass safety test).

To further improve the power of the LED light bulbs, using a switch-type power source is a preferred choice to get better power usage efficiency. But using the switch-type power source has to pass rigorous safety test, including high voltage applying test, in which a voltage approaching four thousand volts is applied around the light bulb, and insulation between the switch-type power source in the light bulb and the applied external voltage has to be securely in place. In the conventional techniques adopting the passive power source, the passive power source usually is covered by a shrinking film and injected with adhesive for positioning. The adhesive also can enhance insulation effect. But test results prove that the switch-type power source covered by the shrinking film and encased by the adhesive cannot pass the high voltage applying test.

To enhance the power to meet requirements, adopting the switch-type power source for power supply is a preferable choice, but it must overcome the barrier of passing the safety test. In addition, the LED light bulb with a greater power also have to resolve the heat dissipating problem, hence a metal heat sink is usually required. This creates the difficulty in passing the safety test. Thus these two contradictory factors create greater difficulty in design in the industry.

SUMMARY OF THE INVENTION

In view of the technical problems of the conventional LED light bulbs that have constraints in terms of power enhancement, conversion efficiency and safety test that are implicated, and the existing LED light bulb structure cannot overcome those problems at the same time, the object of the present invention is to provide an improved LED light bulb with reinforced insulation that includes an isolation structure to isolate a power conversion board that drives LEDs to emit light to achieve desired insulation effect and power conversion and output with high efficiency, and also pass the rigorous safety test.

The present invention provides an insulation reinforcing light bulb that includes a light penetrable shell, a power receiving base, a heat sink and an assembling holder located between the light penetrable shell and power receiving base, at least one light source baseboard located in the light penetrable shell and a power conversion board electrically connected to the light source baseboard and the power receiving base. The heat sink has a housing chamber to hold the power conversion board. The light bulb of the invention further provides an isolation element in the housing chamber. The isolation element has an isolation wall interposed between the power conversion board and the heat sink to form a circuit housing compartment to hold the power conversion board, and a wiring outlet located on the isolation wall to allow wires to be led from the power conversion board to connect to the light source baseboard.

By coupling the isolation element with the assembling holder, the power conversion board can be fully isolated from the heat sink to enhance insulation capability, thus the power conversion board can further provide greater power and conversion efficiency. In addition, by installing a plurality of LEDs and conductive circuits on the light source baseboard, heat generated by the powerful LEDs can be rapidly conducted to the heat sink through the light source baseboard. Through the foregoing structural features, an LED light bulb including the power conversion board and powerful LEDs is formed, and it also has sufficient insulation capability to pass safety test.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
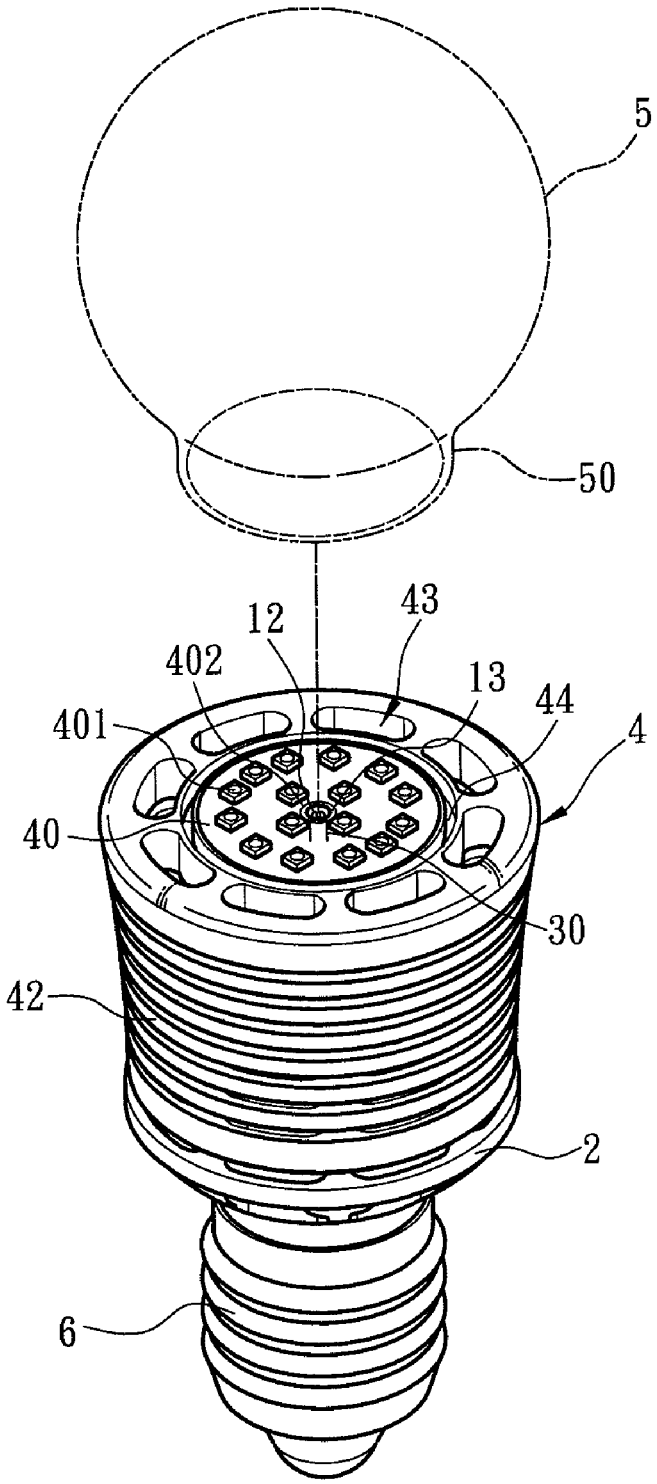
FIG. 1 is an exploded view of the LED light bulb of the invention.

The present invention aims to provide an insulation reinforcing light bulb. Please refer to FIGS. 1, 2 and 3 for a first embodiment of the invention. The light bulb includes a light penetrable shell 5, a power receiving base 6, a heat sink 4 and an assembling holder 2 located between the light penetrable shell 5 and the power receiving base 6, at least one light source baseboard 40 located in the light penetrable shell 5 and a power conversion board 3 electrically connected to the light source baseboard 40 and the power receiving base 6. The power conversion board 3 is preferably a switch-type power circuit. The heat sink 4 has a housing chamber 41 to hold the power conversion board 3. The light bulb further contains an isolation element 1 which includes an isolation wall 10 interposed between the power conversion board 3 and the heat sink 4 to form a circuit housing compartment 14 to hold the power conversion board 3 and a wiring outlet 12 located on the isolation wall 10 to allow wires to be led from the power conversion board 3 to connect to the light source baseboard 40. To pass safety test, the isolation element 1 has a protruding portion 13 formed on the perimeter of the wiring outlet 12 to avoid puncture of high voltage power. In the embodiment shown in FIGS. 1 through 3, the isolation wall 10 encases the upper side and lateral sides of the power conversion board 3 and has a coupling portion 11 formed thereon. The assembling holder 2 has a continuous insulation wall 21 at one side and a fastening portion 22 at another side. The insulation wall 21 has at least one first positioning portion 211 on the outer edge thereof. The coupling portion 11 of the isolation wall 10 is tightly coupled on the inner edge of the insulation wall 21 (referring to FIG. 4); or to facilitate coupling of the insulation wall 21 and coupling portion 11, the coupling portion 11 may be formed with a shrunk outer side and the insulation wall 21 also has a corresponding shrunk inner side 212 to form a complementary coupling therewith (referring to FIGS. 1, 2 and 3). The drawings show merely one embodiment, and do not limit the coupling portion 11 and insulation wall 21 to respectively have the shrunk outer side and shrunk inner side 212. Such a technique is known to those skilled in the art, hence any alterations thereof shall be included in the scope of the invention. By coupling the coupling portion 11 with the inner edge of the insulation wall 21, the power conversion board 3 can be securely isolated and insulated in the circuit housing compartment 14.

The heat sink 4 holds the light source baseboard 40 with a plurality of LEDs 401 located thereon. The light source baseboard 40 can be an aluminum baseboard containing a plurality of conductive circuits. The light source baseboard 40 having the conductive circuits is formed by stacking a copper foil, heat conduction and insulation material and an aluminum plate together based on the present techniques, and then the copper foil is etched to form circuits and encased by the heat conduction and insulation material and aluminum plate. The technique of forming the aluminum baseboard is known in the art, although it is employed herein, it is not the main feature of the invention, thus details are omitted. The heat sink 4 has a preset wedge portion 410. Through compression, the light source baseboard 40 can be tightly coupled with the wedge portion 410 so that the light source baseboard 40 is firmly held on the heat sink 4. The heat sink 4 and the annular inner edge of the light source baseboard 40 form the housing chamber 41 with an opening to hold the isolation element 1 and insulation wall 21. The light source baseboard 40 further has a wiring hole 402 communicating with the housing chamber 41. The heat sink 4 has at least one second positioning portion 411 on the inner edge mating and latching with the first positioning portion 211 of the insulation wall 21. The first and second positioning portions 211 and 411 can be a notch and a lug mating and latching with each other. Thereby the insulation wall 21 and isolation element 1 are encased in the housing chamber 41. The invention also provides at least one power cord 30 connected to the power conversion board 3 and passing through the wiring outlet 12 of the isolation wall 10 and wiring hole 402 of the light source baseboard 40 to form electrical connection between the LEDs 401 and the power conversion board 3. The protruding portion 13 can be wedged in the wiring hole 402.

By means of the structure set forth above, the power conversion board 3 is held inside the LED light bulb and is isolated and protected in the circuit housing compartment 14 through the isolation element 1 and assembling holder 2. Furthermore, the isolation wall 10 and the inner edge of the heat sink 4 can be spaced from each other by a gap to protect the power conversion board 3 from being damaged in the safety test.

Figure 2:
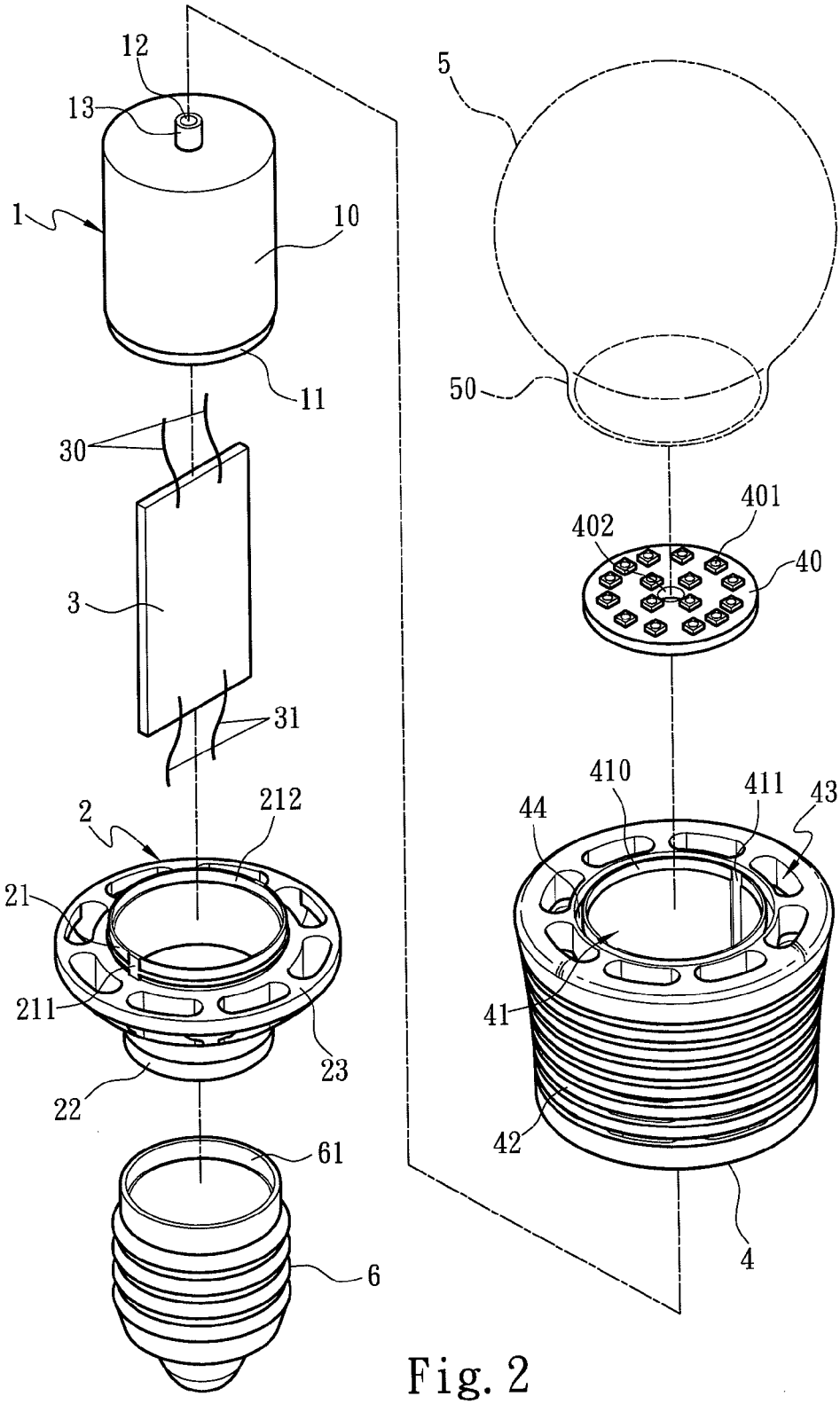
FIG. 2 is a schematic view of the LED light bulb of the invention in an assembling condition.
Figure 3:
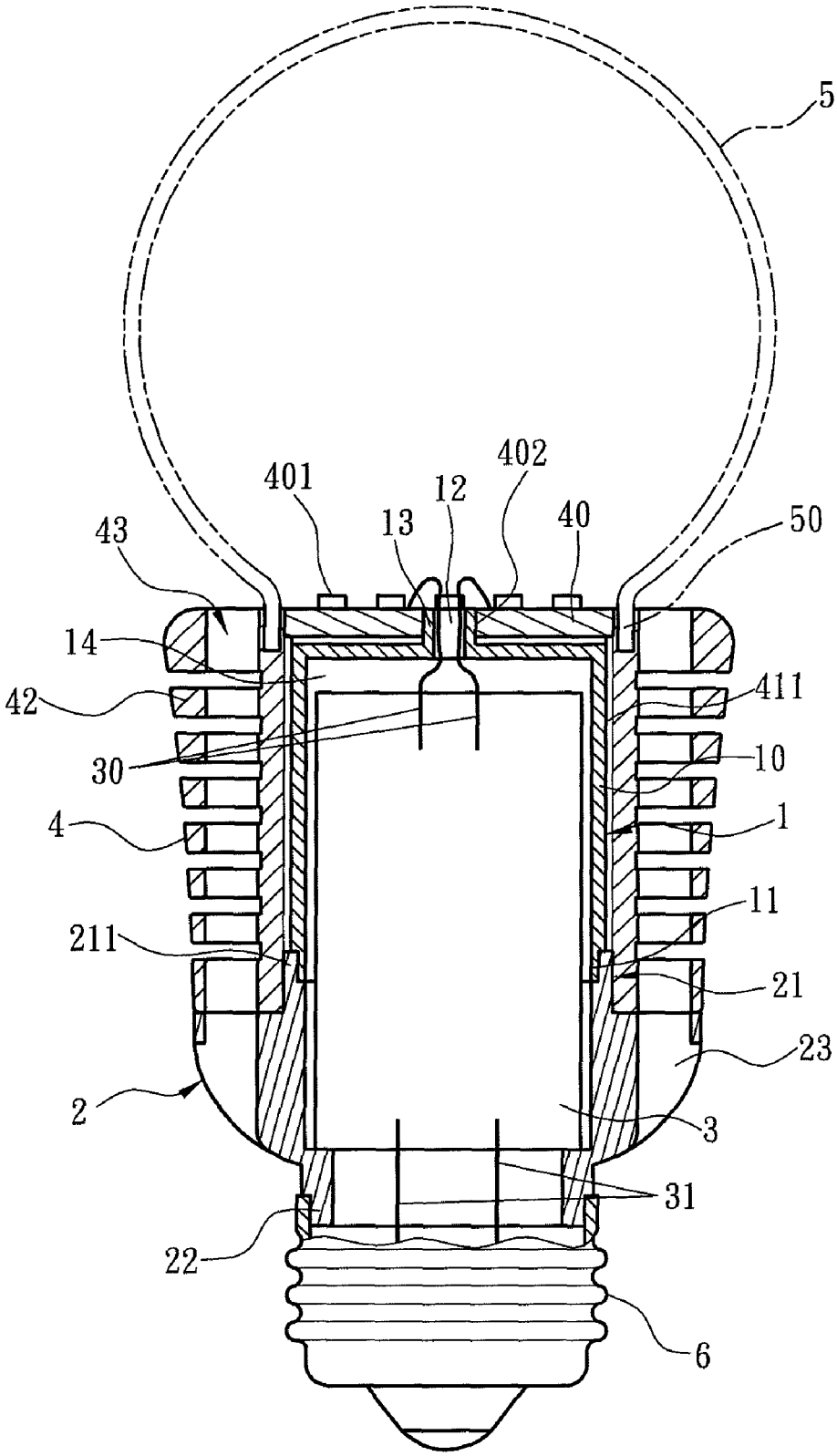
FIG. 3 is a sectional view of the LED light bulb of the invention.

Referring to FIGS. 1, 2 and 3, the fastening portion 22 of the assembling holder 2 is located outside the housing chamber 41 to couple with a fastening end 61 of the power receiving base 6. The power receiving base 6 is connected to an external power source. The power conversion board 3 is electrically connected to the power receiving base 6 via at least one power cord 31 to conduct electric power from the external power source to the power conversion board 3. Depending on different types or application environments of the light bulb, various types of the power receiving base 6 can be selected. FIGS. 1, 2 and 3 show a type of the ordinary household light bulb, but the type of the power receiving base 6 is not limited to the one shown in FIGS. 1, 2 and 3 of the invention.

The heat sink 4 has a positioning groove 44 formed at the outer side of the wedge portion 410 to hold the light penetrable shell 5. The light penetrable shell 5 has a neck portion 50 to be tightly held in the positioning groove 44; another alternative is to incorporate with adhesive to allow the neck portion 50 to be bonded in the positioning groove 44.

Figure 4:
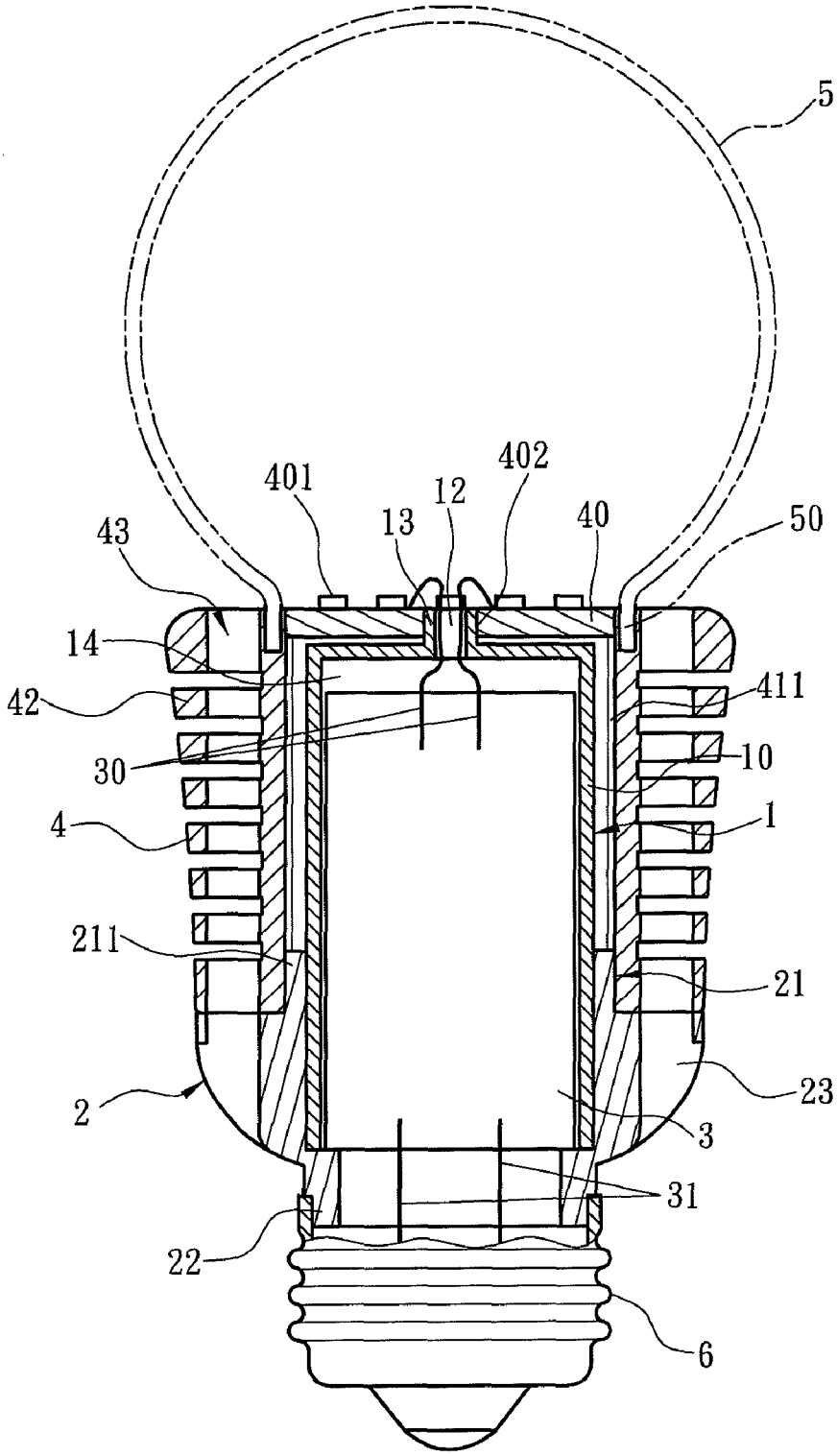
FIG. 4 is a sectional view of another embodiment of the invention showing that the isolation element and the assembling holder are tightly coupled.

Refer to FIG. 4 for another embodiment of the light bulb. It differs from the first embodiment by directly coupling the coupling portion 11 with the inner edge of the insulation wall 21 through dimensional design thereof without forming the shrunk inner side and shrunk outer side. Such an approach does not need to reduce the thickness of the coupling portion 11 and insulation wall 21, thus can provide greater insulation capability.

In the first embodiment shown in FIGS. 1, 2 and 3 and second embodiment shown in FIG. 4, the heat sink 4 has a plurality of radiation fins 42 located on the outer side stacked in an overlapped manner. The radiation fins 42 are spaced from one another with gaps between them to facilitate air circulation, and also have a plurality of vents 43 spaced from one another with constant distance to form at least one longitudinal airflow passage running through the heat sink 4 to allow air to pass through. The assembling holder 2 also has at least one airflow guide portion 23 with a plurality of reserved space to guide the airflow to pass through the vents 43. The gaps among the radiation fins 42 and airflow passage allow air circulation in transverse and longitudinal manner to increase contact area with the air to achieve desired cooling effect.

While the embodiments previously discussed define the isolation wall 10 to continuously encase the upper side and lateral sides of the power conversion board 3, it can be extended to between the power conversion board 3 and power receiving base 6 and include another wiring outlet (not shown in the drawings) formed thereon to allow wires to be led from the power conversion board 3 to connect to the power receiving base 6. All this is not the limitation of the invention. While the invention has been described by means of specific embodiments, numerous modifications and variations could be made thereto by those skilled in the art without departing from the scope and spirit of the invention set forth in the claims.

In summation of the above description, the present invention provides a significant improvement over the conventional techniques and complies with the patent application requirements, and is submitted for review and granting of the commensurate patent rights.

What is claimed is:

1. An insulation reinforcing light bulb including a light penetrable shell, a power receiving base, a heat sink and an assembling holder located between the light penetrable shell and the power receiving base, at least one light source baseboard located in the light penetrable shell, and a power conversion board electrically connected to the light source baseboard and the power receiving base; the heat sink including a housing chamber to hold the power conversion board, the light bulb further comprising:

an isolation element which is held in the housing chamber and includes an isolation wall interposed between the power conversion board and the heat sink to form a circuit housing compartment to hold the power conversion board, and a wiring outlet formed on the isolation wall to allow wires to be led from the power conversion board to connect to the light source baseboard;

wherein the assembling holder includes an insulation wall with an inner edge to tightly couple with the isolation wall.

2. The insulation reinforcing light bulb of claim 1, wherein the power conversion board is a switch-type power circuit.

3. The insulation reinforcing light bulb of claim 1, wherein the isolation wall and the insulation wall include respectively a shrunk outer side and a shrunk inner side complementary to each other to form tight coupling.

4. The insulation reinforcing light bulb of claim 1, wherein the assembling holder and the heat sink include respectively a first positioning portion and a second positioning portion mating and latching with each other.

5. The insulation reinforcing light bulb of claim 4, wherein the first positioning portion and the second positioning portion are respectively a notch and a lug mating and latching with each other.

6. The insulation reinforcing light bulb of claim 1, wherein the assembling holder includes a fastening portion located outside the housing chamber to couple with the power receiving base.

7. The insulation reinforcing light bulb of claim 1, wherein the isolation element includes a protruding portion on the perimeter of the wiring outlet.

8. The insulation reinforcing light bulb of claim 7, wherein the light source baseboard includes a wiring hole communicating with the housing chamber to allow at least one power cord to pass through to form electrical connection with the light source baseboard.

9. The insulation reinforcing light bulb of claim 8, wherein the protruding portion is wedged in the wiring hole of the light source baseboard.

10. The insulation reinforcing light bulb of claim 1, wherein the light source baseboard includes a wiring hole communicating with the housing chamber to allow at least one power cord to pass through to form electrical connection with the light source baseboard.

11. The insulation reinforcing light bulb of claim 1, wherein the light source baseboard is an aluminum baseboard including a plurality of conductive circuits.

12. The insulation reinforcing light bulb of claim 1, wherein the heat sink includes a plurality of radiation fins stacked and overlapped with each other, the radiation fins including a plurality of vents to form at least one airflow passage.

13. The insulation reinforcing light bulb of claim 1, wherein the isolation wall is extended to between the power conversion board and the power receiving base, and includes another wiring outlet formed thereon to allow wires to be led from the power conversion board to connect to the power receiving base.

14. An insulation reinforcing light bulb including a light penetrable shell, a power receiving base, a heat sink and an assembling holder located between the light penetrable shell and the power receiving base, at least one light source baseboard located in the light penetrable shell, and a power conversion board electrically connected to the light source baseboard and the power receiving base; the heat sink including a housing chamber to hold the power conversion board, the light bulb further comprising:

an isolation element which is held in the housing chamber and includes an isolation wall interposed between the power conversion board and the heat sink to form a circuit housing compartment to hold the power conversion board, and a wiring outlet formed on the isolation wall to allow wires to be led from the power conversion board to connect to the light source baseboard;

wherein the assembling holder and the heat sink include respectively a first positioning portion and a second positioning portion mating and latching with each other.

15. The insulation reinforcing light bulb of claim 14, wherein the first positioning portion and the second positioning portion are respectively a notch and a lug mating and latching with each other.

* * * * *